United States Patent [19]

Grabbe et al.

[11] Patent Number: 4,687,278

[45] Date of Patent: Aug. 18, 1987

[54] CONTACT SOCKET WITH IMPROVED CONTACT FORCE

[75] Inventors: Dimitry Grabbe, Middletown; Iosif Korsunsky, Harrisburg, both of Pa.

[73] Assignee: AMP Incorporated, Harrisburg, Pa.

[21] Appl. No.: 891,709

[22] Filed: Jul. 31, 1986

[51] Int. Cl.[4] ..... H01R 13/11

[52] U.S. Cl. ..... 439/842

[58] Field of Search ..... 339/258 R, 258 P, 256 R, 339/259 R

[56] References Cited

U.S. PATENT DOCUMENTS

| | | | |
|---|---|---|---|
| 3,262,088 | 7/1966 | West | 339/258 R |
| 3,663,931 | 5/1972 | Brown | 339/256 R X |
| 4,152,042 | 5/1979 | Ostapovitch | 339/258 R |
| 4,168,880 | 9/1979 | Tesch | 339/259 R |
| 4,550,972 | 11/1985 | Romak | 339/256 R |

*Primary Examiner*—William R. Briggs

*Attorney, Agent, or Firm*—Bruce J. Wolstoncroft

[57] ABSTRACT

A contact socket having ends and an intermediate portion for receiving a contact pin. The intermediate portion has a plurality of resilient beams which are designed to provide the necessary contact force while maintaining the insertion force at a low level. The beams are also designed to allow for improper insertion of the pin into the contact socket without damaging the resilient beams so that no permanent set of the beams takes place.

6 Claims, 3 Drawing Figures

CONTACT SOCKET WITH IMPROVED CONTACT FORCE

FIELD OF THE INVENTION

This invention relates to a contact socket of the type which receives electrical contact pins. More particularly it relates to a contact socket which increases the contact force of the socket on the contact pins while maintaining a relatively low insertion force.

BACKGROUND OF THE INVENTION

A commonly used type of contact terminal comprises a stamped and formed conductive metal box-like socket. Contact terminals of this type are widely used, often in multicontact electrical connectors as well as in connectors containing only one or two terminals.

Contact sockets of this type must be dimensioned such that when the pin is inserted into the socket, a contact force will be exerted by the socket on the pin to form a stable electrical connection between the socket and the pin. Frequently, a separate contact spring is mounted on the socket such that when the pin is inserted into the socket, the spring is deflected, forcing the surface of the pin against the surface of the contact. In order to obtain a stable electrical connection between the inserted pin and the socket, it is desirable that the contact spring exert a relatively high force on the pin. Thus the force required to insert the pin into the socket is also relatively high. In other words, the greater the spring force, the greater the insertion force required to mate the pin with the socket.

High insertion forces, as described, are not desirable in high pin count pin-an-socket type contacts. As a result, such contact terminals are often designed with an acceptable insertion force requirement coupled with an acceptable contact force. One such method of obtaining acceptable contact force and insertion force is described in U.S. Pat. No. 4,550,972. The apexes of each corresponding pair of beams are spaced such that they are encountered sequentially during movement of the pin into the socket. This type of design allows for acceptable contact force and insertion force, however, problems have occurred. As the pin is inserted into the socket, there is a likelihood that the pin will be inserted at some relation relative to the socket because in practice it is unrealistic to expect the axis of the pin to align perfectly with the axis of the socket. Consequently, the beams will not be contacted at the same time or with the same amount of force, causing some of the relatively weak, flexible beams to be greatly deformed, exceeding the elastic limit of the contact material, thus causing permanent deformation and loss of contact force.

The present invention is directed to the achievement of an improved contact socket which is capable of exerting a relatively high contact force on an inserted pin and which does not require an unduly high insertion force when it is mated with the contact pin. Additionally, the beams of the socket are designed to compensate for lateral displacement of the pin and to allow the pin to be inserted at an angle relative to the socket with no harm being done to the beams, i.e. no permanent set which allows the beams to retain their resilient characteristics.

SUMMARY OF THE INVENTION

The invention is directed to a contact socket for reception of a contact pin. The contact socket has end portions and an intermediate portion. The intermediate portion has a plurality of at least two beams which are integrally connected to the ends and are equally spaced around the axis of the socket so that at least a pair of diametrically opposed beams are provided. Each of the beams is designed in such a manner as to allow for improper insertion of the pin into the socket without damaging the resilient beams.

An object of the present invention is a contact socket which has flexible resilient beams which will not take a permanent set if the contact pin is inserted at an improper angle or if the pin is laterally displaced from the socket.

Another object of the invention is to permit an increase of the contact force while maintaining or not measurably increasing the insertion force required.

Another object of the present invention is to provide a contact surface which allows the point of contact between the terminals and the posts to occur at the center of the post, as compared to a corner of the post. The burr and the fractured edge on the post is the usual location of pin holes in plating and the source of corrosion sites causing unreliable electrical connection.

DETAILED DESCRIPTION OF THE INVENTION

Figures 1, 2, 3:
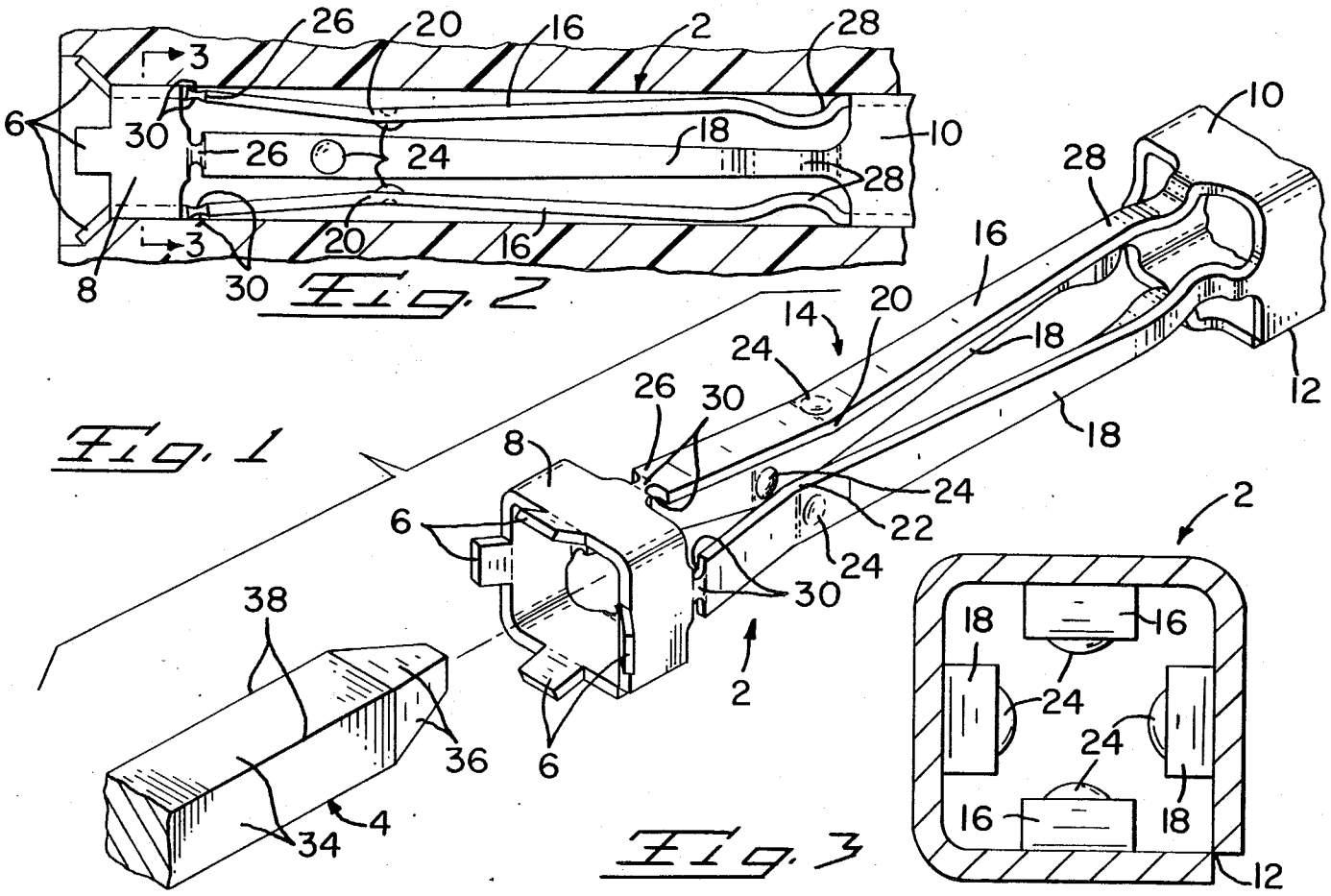
FIG. 1 is perspective view of a contact socket in accordance with the invention showing part of a contact pin in alignment with the socket.
FIG. 2 is a top plan view of the socket.
FIG. 3 is a cross-sectional view taken along line 3—3 of FIG. 2, showing the spacing of the contact sections.

A contact socket 2 in accordance with the invention is adapted to receive a contact pin 4 therein to form a disengageable electrical connection between conductors (not shown) secured to the pin and socket respectively.

Socket 2 comprises a box-like receptacle portion having a square-shaped pin receiving end 8 and a square-shaped securing end 10. Pin receiving end 8 may have flared projections 6 as shown in FIG. 1 to guide pin 4 into the socket 2. Socket 2 is stamped and formed from a flat blank such that seam 12 extends along pin receiving end 8 and securing end 10 in a corner of socket 2 as shown in FIGS. 1 and 3. End 8 and end 10 have essentially the same dimensions, the inside dimensions of which are greater than the dimensions of the pin. The intermediate portion 14 of box-like socket 2 is composed of associated pairs of beams 16, 18 which extend axially and which have their ends fixed to the square-shaped ends 8, 10. The two beams of each pair 16 and 18 are diametrically opposed to each other with respect to the axis of the receptacle portion and the beams are substantially identical to each other so that they will behave in a uniform manner when deflected.

Beams 16, 18 slope toward the axis of intermediate portion 14 such that apexes 20, 22 of the beams 16, 18 define a smaller opening than do ends 8, 10. At the apexes 20, 22, each beam 16, 18 has a shallow "V" configuration with an embossment 24 positioned thereon to ensure a positive electrical connection with the pin 4 as will be discussed. However, each opposing pair of beams 16 has their apexes 20 spaced from the apexes 22 of the other pair of beams 18 such that when pin 4 enters the intermediate portion 14, pin 4 will first encounter the apexes 20 of one pair of beams 16, after which the apexes 22 of the second pair of beams 18 will be encountered. This arrangement allows pin 4 to be inserted under reduced insertion force conditions. By staggering the apexes 20, 22 of the pairs of beams 16, 18, pin 4 must only force two beams 16 or 18 apart at one time. Once the beams 16, 18 are displaced, pin 4 encounters only frictional force from those beams. The frictional force is much less than the displacement force and, consequently, by staggering apexes 20, 22, pin 4 encounters the maximum forces from each pair of beams 16, 18 at different times, thereby reducing the force required to insert pin 4 into socket 2.

The insertion force is also reduced slightly due to the specially designed shape of beams 16, 18. As can be seen in FIGS. 1 and 2, beams 16, 18 narrow at inner ends 28. At outer ends 26 of beams 16, 18 adjacent end 8, recesses 30 are formed in beams 16, 18. These recesses 30 allow the connection point between beams 16, 18 and end 8 to behave in the same manner as a pivot point, holding beams 16, 18 in place but exerting minimal force on pin 4 as it is inserted into intermediate portion 14. Inner ends 28 of beams 16, 18 adjacent end 10 gradually narrows from proximate the apexes 20, 22 of the beam 16, 18 to end 10. This narrowing of the beams 16, 18 also renders the beams less rigid and causes the spring rates to be substantially smaller than a uniform beam would provide. Inner ends 28 are also bowed inward as shown in FIG. 2. This curvature allows beams 14, 16 to be deformed as required during insertion without changing the overall length of socket 2. The curvature acts as a compliant section allowing each beam to deform a different distance relative to the other beams without exerting harmful forces on socket 2.

Recesses 30 and the narrowing of inner end 28 of beams 16, 18 reduces the insertion force required for insertion of pin 4 into intermediate portion 14. But even more importantly, recesses 30 and the narrowing of the beams make beams 16, 18 less rigid and therefore more resilient. This is extremely important in receptacles of this type. The more flexible member allows beams 16, 18 to be displaced by pin 4 a greater distance without having the beams 16, 18 take a permanent set. In other words, pin 4 may be inserted at an improper relation relative to the socket 2 without damaging beams 16, 18. The flexible beams will bend into proper alignment, no set of the resilient beams 16, 18 takes place and therefore no loss of contact force, due to the permanent set of the beams, takes place. Thus, the design of beams 16, 18 allows the socket 2 to be more user friendly, preventing harm to the beams 16, 18 from improper insertion and ensuring that the proper contact force is maintained.

The improper relation mentioned above may occur in two different ways; either through lateral displacement of pin 4 relative to socket 2 or through an improper angle of insertion of pin 4 relative to socket 2. The amount of lateral displacement that socket 2 can accommodate is limited to the inside diameter of end 8. The furthest off center pin 4 can be and still be inserted into socket 2 occurs when pin 4 is tangent to an inside surface of end 8. This limitation ensures that the elastic limit of beams 14, 16 cannot be exceeded by lateral displacement of pin 4. Improper angular insertion is also limited. Socket 2 is positioned in a plastic housing 40 having sidewalls 42. Sidewalls 42 act as a stop surface preventing beams 14, 16 from overstress due to improper angular insertion. Therefore, resilient beams 14, 16 are protected from taking a permanent set due to lateral displacement or improper angular insertion.

Apexes 20, 22 of beams 16, 18 are positioned substantially from the center of intermediate portion 14 as can be seen in FIGS. 1 and 2. Pin 4 will contact apexes 20, 22 of beams 16, 18 early in the insertion process. This positioning assures that embossments 24 will contact pin 4 on sides 34 as compared to the pyramid-shaped bottom 36 where more imperfections occur (as was the case in previous sockets). Consequently, the probability of making a positive electrical connection is greatly enhanced.

The contact force or normal force of socket 2 is greatly increased over that of prior sockets to assure that the required force necessary to ensure a positive electrical contact is obtained. This increased contact force is partially obtained by positioning the apexes 20, 22 away for the center of the beams, thereby increasing the normal force component of the spring force. Much of the increased contact force is obtained by increasing the spring force of beams 16, 18 which results in an increase of the insertion force required to insert pin 4 into socket 2. However, since the insertion force is reduced due to staggering of the apexes 20, 22, as previously discussed, the insertion force of socket 2 with increased contact force is essentially the same as the insertion force of the prior sockets having insufficient contact force.

The reason for embossments 24 and the V-shaped configuration of beams 16, 18 is to localize the area of the contact between beams 16, 18 and a center section of the pin's flat sides 34, thus making the contact occur away from edges 38 of pin 4, thereby minimizing the probability of pin holes present in the contact area and therefore lessening the probability of corrosion occurring in this critical area.

Contact sockets 2 in accordance with the invention possess many desirable qualities of which increased contact pressure, low insertion force, and a better contact surface are but a few. But perhaps the most beneficial aspect of this invention is that the insertion of pin 4 into socket 2 does not have to be perfectly coincident with the axis of socket 2. The pin 4 may be laterally displaced or inserted at an angle without having resilient beams 16, 18 take a permanent set. Consequently, this socket is more practical for use in the field where precise alignment of the pin to the socket seldom, if ever, takes place. In other words, the useful life of this socket is extended due to the flexible beams 16, 18.

What is claimed is:

1. A contact socket for receiving a contact pin, the contact socket comprising:

a pin receiving end and an inner end, the inside dimensions of the ends being greater than the dimensions of the pin;

an intermediate portion between the pin receiving end and the inner end having an even number of at least two similar beams which are integrally attached to the pin receiving end as well as the inner end, the beams being equally spaced around the axis of the socket;

each of the beams projecting inward toward the axis of the socket such that a contact section is provided at an apex of the beam which nearest the axis of the socket;

an embossment positioned on the apex of each beam, the embossment projecting inwardly towards the axis of the socket, the embossments on each pair of opposed beams being aligned with respect to the axis of the socket, the minimum distance between the surfaces of the embossments being less than the diameter of the contact pin;

the associated pairs of beams having their embossments spaced from the pin receiving end; and each of the beams having recesses provided proximate the pin receiving end to allow the outer end of the beam to operate as a pivot point, and each of the beams being tapered from proximate the contact section to the inner end, the recesses and tapering allowing the beams to be more resilient, preventing the beams from taking a permanent set when the pin is inserted at an improper angle of insertion.

2. A contact socket as recited in claim 1 wherein the contact sections and embossments are positioned nearer the pin receiving end than the inner end, ensuring that the electrical contact between the embossments and the pin will occur on the sides of the pin, where better electrical contact is likely, this positioning also allowing a greater contact force to be applied on the pin by the beams.

3. A contact socket as recited in claim 1 wherein the pin receiving end has outwardly flared projections to guide the pin into the contact socket.

4. A contact socket as recited in claim 1 wherein the contact socket is in the shape of a box-like receptacle.

5. A contact socket as recited in claim 4 wherein the intermediate portion has pairs of essentially identical beams, each of which defines a respective side of the box-like structure.

6. A contact socket as recited in claim 1 wherein the inner end of each beam is bowed inward to provide a compliant section thereby enabling each beam to deform a different amount relative to the other beams.

* * * * *